US007708076B2

(12) United States Patent
Richard et al.

(10) Patent No.: US 7,708,076 B2
(45) Date of Patent: May 4, 2010

(54) METHOD OF USING A DRILL IN SAND CONTROL LINER

(75) Inventors: Bennett M. Richard, Kingwood, TX (US); Michael H. Johnson, Katy, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/845,893

(22) Filed: Aug. 28, 2007

(65) Prior Publication Data

US 2009/0057014 A1 Mar. 5, 2009

(51) Int. Cl.
*E21B 19/00* (2006.01)
*E21B 23/00* (2006.01)
*E21B 43/34* (2006.01)
*E21B 10/64* (2006.01)

(52) U.S. Cl. ..... 166/377; 175/314; 175/257

(58) Field of Classification Search ..... 175/57, 175/257, 262, 314; 166/376, 377
See application file for complete search history.

(56) References Cited

U.S. PATENT DOCUMENTS

| | | | | | |
|---|---|---|---|---|---|
| 4,604 | A | * | 6/1846 | Bignall | 48/102 R |
| 51,508 | A | * | 12/1865 | Batcheller | 175/314 |
| 61,400 | A | * | 1/1867 | Cole | 175/22 |
| 65,276 | A | * | 5/1867 | Ricker | 175/19 |
| 757,124 | A | * | 4/1904 | Kempfe | 175/395 |
| 1,983,428 | A | * | 12/1934 | Zeidler, Jr. | 166/264 |
| 2,855,049 | A | | 10/1958 | Zandmer | |
| 2,913,052 | A | | 11/1959 | Harmon | |
| 3,224,506 | A | | 12/1965 | Huitt et al. | |
| 3,245,472 | A | | 4/1966 | Zandmer | |
| 3,301,337 | A | | 1/1967 | Vaughn et al. | |
| 3,347,317 | A | | 10/1967 | Zandmer | |
| 3,390,724 | A | | 7/1968 | Caldwell | |
| 3,425,491 | A | | 2/1969 | Zandmer | |
| 3,552,489 | A | * | 1/1971 | Berryman | 166/120 |

(Continued)

FOREIGN PATENT DOCUMENTS

GB 2277337 A1 10/1994

(Continued)

OTHER PUBLICATIONS

Fuller, M.S., et al.; Innovative Way to Cement a Liner Utilizing a New Inner Spring Liner Cementing Process; 1998 IADC/SPE Conference, Mar. 3-6; Dallas, Texas pp. 501-504.

(Continued)

*Primary Examiner*—David J Bagnell
*Assistant Examiner*—Cathleen R Hutchins
(74) *Attorney, Agent, or Firm*—Steve Rosenblatt

(57) ABSTRACT

A liner rotates a bit to make more hole. The liner has openings with inserts in them to lend torque resistance to the liner. The inserts have a passage with a send control media in the passage and a seal so that the liner can hold pressure for run in to get proper circulation through the bit. When sufficient hole is made, the liner is hung off an existing cemented tubular and the seal for the passages with the sand control media is removed by a variety of techniques so that the formation can be produced in a single trip.

18 Claims, 1 Drawing Sheet

U.S. PATENT DOCUMENTS

| | | | | |
|---|---|---|---|---|
| 4,285,398 | A | 8/1981 | Zandmer et al. | |
| 4,401,158 | A | 8/1983 | Spencer et al. | |
| 4,750,571 | A | 6/1988 | Geeting | |
| 4,825,944 | A | 5/1989 | Mays | |
| 4,949,788 | A * | 8/1990 | Szarka et al. | 166/285 |
| 5,165,478 | A | 11/1992 | Wilson | |
| 5,228,518 | A | 7/1993 | Wilson et al. | |
| 5,330,003 | A | 7/1994 | Bullick | |
| 5,355,948 | A | 10/1994 | Sparlin et al. | |
| 5,425,424 | A | 6/1995 | Reinhardt et al. | |
| 5,445,220 | A | 8/1995 | Gurevich et al. | |
| 5,632,348 | A | 5/1997 | Yunan | |
| 5,823,254 | A | 10/1998 | Dobson et al. | |
| 5,829,520 | A | 11/1998 | Johnson | |
| 5,884,702 | A | 3/1999 | Yokley et al. | |
| 5,947,200 | A | 9/1999 | Montgomery | |
| 6,006,838 | A | 12/1999 | Whiteley et al. | |
| 6,009,947 | A | 1/2000 | Wilson et al. | |
| 6,095,247 | A * | 8/2000 | Streich et al. | 166/299 |
| 6,164,126 | A | 12/2000 | Ciglenec et al. | |
| 6,408,945 | B1 | 6/2002 | Telfer | |
| 6,543,545 | B1 | 4/2003 | Chatterji et al. | |
| 6,732,806 | B2 | 5/2004 | Mauldin et al. | |
| 6,742,606 | B2 * | 6/2004 | Metcalfe et al. | 175/57 |
| 6,766,858 | B2 | 7/2004 | Nguyen et al. | |
| 6,799,645 | B2 | 10/2004 | Mason et al. | |
| 6,877,553 | B2 | 4/2005 | Cameron | |
| 7,108,083 | B2 * | 9/2006 | Simonds et al. | 175/57 |
| 7,316,274 | B2 | 1/2008 | Xu et al. | |
| 7,401,648 | B2 | 7/2008 | Richard | |
| 2003/0136562 | A1 | 7/2003 | Robison et al. | |
| 2005/0194143 | A1 | 9/2005 | Xu et al. | |
| 2007/0039741 | A1 * | 2/2007 | Hailey, Jr. | 166/376 |

FOREIGN PATENT DOCUMENTS

| | | | |
|---|---|---|---|
| WO | 03-052238 | A1 | 6/2003 |
| WO | 03052238 | A1 | 6/2003 |
| WO | 03-104611 | A1 | 12/2003 |
| WO | 03104611 | A1 | 12/2003 |
| WO | 2005-056977 | A1 | 6/2005 |

OTHER PUBLICATIONS

Coronado, Martin P., et al., "Enabling Technologies for Drill-In Sand Screen Liners", SPE 110500, Nov. 2007, 1-7.

Coronado, Martin P., et al., "Next-Generation Sand Screen Enables Drill-In Sandface Completions", SPE 113539, Jun. 2008, 1-13.

Mehmood, A., et al., "Slimhole Drilling With Expandable Sand Screens for Low-Cost, High-Deliverability Wells at Bhit Gas Filed in Pakistan", SPE 95896, Oct. 2005, 1-15.

* cited by examiner

METHOD OF USING A DRILL IN SAND CONTROL LINER

FIELD OF THE INVENTION

The field of the invention is liners that are rotated to drill without a drill string and more particularly where the liners have openings with sand control devices and the openings are unsealed after drilling is complete.

BACKGROUND OF THE INVENTION

Saving trips into the well saves the well operator money. One such time saving technique that has been developed is running a liner with screens on a drill string so that as the bit advances so does the liner. When the desired location is reached, the drill string up to the bit is released from the bit that is rotatably mounted to the liner. The liner doesn't rotate as the bit turns. After the drill string is disconnected from the bit and removed, a swage can be run in to expand the screen or an isolation packer and a crossover can be run in and a gravel pack operation can be performed. This technique is illustrated in U.S. Pat. No. 7,108,083. The bit can be driven by a drill string or a downhole motor supported by coiled tubing.

Drill strings have been used with screens in the liner when running in liner while drilling the hole because of the need to deliver pressurized drilling mud to the bit nozzles to displace the drill cuttings and cool the bit. Since the screen is an open structure, it has not been practical to deliver liner while making hole without using a drill string inside the liner so that pressurized mud can be directly delivered to the bit while the drill string supports the liner in a manner where the liner doesn't see fluid pressure in advance of the bit.

In trying to eliminate the drill string and rotate a bit with a liner, particularly a liner that has screens or an array of slots, the problem that is confronted is the limited ability of such a structure to tolerate the applied torque from drilling and how to make the structure a conductor of pressurized fluid so that the bit nozzles could be supplied with cooling fluid and a means to get drill cuttings out of the way. Another consideration is to avoid perforation using explosives as it can cause damage to sensitive formations and the perforating guns can become stuck after detonation in low bottom hole pressure wells. The present invention solves these problems by providing a robust liner structure that can withstand the applied torque and drive the bit while still having the capability to convey pressure to the bit nozzles and when drilling is concluded to open passages with sand control features so that production can begin with the liner suspended and sealed to an existing and cemented well tubular. These and other features of the present invention will be more readily apparent from a review of the description of the preferred embodiment and the associated drawing while recognizing that the claims determine the full scope of the invention.

SUMMARY OF THE INVENTION

A liner rotates a bit to make more hole. The liner has openings with inserts in them to lend torque resistance to the liner. The inserts have a passage with a sand control media in the passage and a seal so that the liner can hold pressure for run in to get proper circulation through the bit. When a sufficient hole is made, the liner is hung off an existing cemented tubular and the seal for the passages within the sand control media is removed by a variety of techniques so that the formation can be produced in a single trip.

DETAILED DESCRIPTION OF THE PREFERRED EMBODIMENT

Figure 1A:
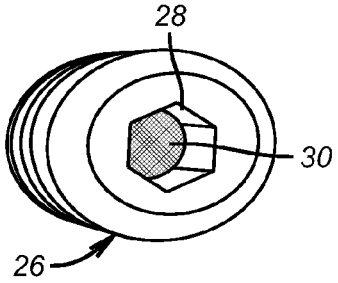
FIG. 1*a* is an enlarged view of the insert.
Figure 1:
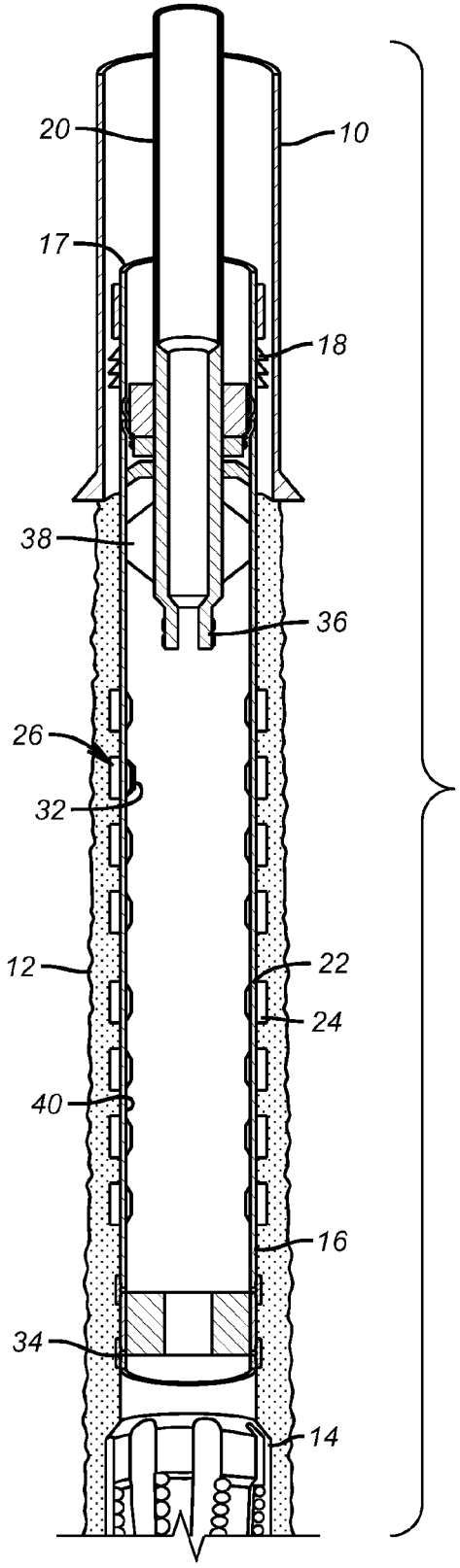
FIG. 1 is a section view of the tubular making hole with the bit at the bottom and a detailed view of an insert in one of the openings.

FIG. 1 shows a casing 10 that has been cemented in wellbore 12. Wellbore 12 is drilled with bit 14 secured to liner string 16 in a manner where they rotate in tandem. Near the top 17 of the string 16 is a liner hanger 18 of a type well known in the art. When the wellbore 12 is drilled, the hanger 18 with its slips and seal can be actuated so that the string 16 is supported by the casing 10. A run in string 20 delivers the liner string 16 through the casing 10 in drilling the hole 12 to drive the bit 14 by virtue of a releasably and rotationally locked latch connection 37 of a type well known in the art.

String 16 has an array of holes 22 with internal threads 24 to allow securing insert 26 at its threads in holes 22. Inserts 26 can be welded into position but a threaded connection is preferred as it is cheaper to assemble and allows fast removal for replacement of any inserts 26 when needed. Each insert 26 has a passage 28 therethrough. Inside passage 28 is a sand control medium 30 that is preferably sintered metal beads compatible with the anticipated well fluids and conditions. Illustratively shown for a single opening but present in all openings 22 is a sealing material 32 so that pressurized drilling mud delivered through run in string 20 is retained in the liner 16 and communicated to bit 14 to allow it to drill. Bit 14 may be releasably mounted to the lower end 34 of the liner 16 and run in string 20 can have a gripping mechanism, shown schematically as 36 at its lower end. The gripping mechanism 36 can grab the bit 14 which can be of a collapsible design so that it can be retrieved back through the liner 16 when drilling is done. Alternatively, the run in string 20 can also include a swage, shown schematically as 38 so that at the conclusion of drilling, the liner 16 can be expanded in the same trip. If the liner is expanded, the bit 14 need not have a collapse feature to be removed through it after expansion.

In drilling the wellbore 12, the run in string 20 and the liner 16 are rotated to turn the bit 14 to make the hole 12. The sealing material 32 initially plugs the passages 28 so that pressurized drilling mud can be delivered to the bit 14 to carry away cuttings. Drilling continues until the proper depth is reached or until the pressures downhole get so high as to risk fluid loss into the formation and an inability to clear cuttings away from the bit. At that point the sealing material 32 is removed. Depending on what material is selected for sealing, it can be removed in a variety of ways without string rotation. It can be dissolved, chemically attacked or simply designed to go away after prolonged exposure to well fluids or conditions. It can also be removed with a stimulus such as heat applied in the well. The removal, either partial or total of the sealing material 32 allows production to come through the sand control medium 30 and into the liner 16. The well fluids can go to the surface through a production string and packer that replace the run in string 20 or alternatively, production can be taken through the run in string 20 itself saving another two trips for removing the run in string 20 and replacing it with a production string and packer (not shown). If expansion of the liner string 16 is contemplated, it can be done before the sealing material 32 is removed or after but preferably before production to the surface is allowed to start. If the bit 14 is to be retrieved then it should be done before production begins.

The liner string 16 can be set on bottom before production begins or it can have its lower end 34 closed off to flow by other means.

Those skilled in the art will appreciate that a liner string 16 is presented that has the strength in torsion to operate a bit 14 and has the capability of selectively retaining pressure during drilling so that fluid can be forced through the bit nozzles while drilling. Perforating the liner for production access is not required in this situation. The sealing devices 32 are made to go away when drilling is concluded to provide access to production in passages 28. Expansion of the liner 16 is possible in a single trip as is the ultimate capture and retrieval of the bit 14 through the liner 16 regardless of whether the liner is expanded or not. The openings 22 can be threaded in the wall or welded. The interior wall 40 should preferably be smooth with no internal projections if expansion is contemplated. Various known swages and expansion techniques can be used. The number and layout of openings 22 as well as their size can vary depending on the anticipated production rates.

The above description is illustrative of the preferred embodiment and many modifications may be made by those skilled in the art without departing from the invention whose scope is to be determined from the literal and equivalent scope of the claims below.

We claim:

1. A method for producing from a wellbore, comprising:
connecting at least a portion of a tubular string to a bit and rotating them in tandem in the wellbore when drilling the wellbore;
circulating pressurized fluid through said string to said bit to clear cuttings produced during drilling to the surface of the wellbore;
providing at least one selectively open port in said string said port further comprising a sand control media;
drilling the wellbore with said port closed; and
opening said port without string rotation after said drilling to produce well fluids through said sand control media;
retrieving said bit through said string after said drilling.

2. The method of claim 1, comprising:
closing said port with a material that is removable.

3. The method of claim 2, comprising:
using sintered metal beads for said sand control media.

4. The method of claim 3, comprising:
placing a removable material in said port;
leaving said material in position during said drilling;
removing said material after said drilling;
removing said material by exposure to well conditions or a stimulus applied downhole.

5. The method of claim 1, comprising:
using sintered metal beads for said sand control media.

6. The method of claim 1, comprising:
expanding said tubular string in the same trip as said drilling.

7. The method of claim 6, comprising:
running in said tubular string with a run in string;
mounting a swage on said run in string; and
expanding said tubular string with said swage.

8. The method of claim 1, comprising:
securing said tubular string to an existing well tubular after said drilling.

9. The method of claim 8, comprising:
running in said tubular string with a run in string;
producing well fluids through said run in string.

10. The method of claim 8, comprising:
running in said tubular string with a run in string;
removing said run in string and running in a production string with a packer;
producing through said production string.

11. The method of claim 1, comprising:
using a collapsible bit to facilitate its removal through said tubular string.

12. The method of claim 1, comprising:
installing an insert with a passage therethrough in said tubular wall;
placing said sand control media in said passage.

13. The method of claim 12, comprising:
positioning said insert so that it does not protrude beyond the inner wall of said tubular string;
expanding said tubular after said drilling.

14. The method of claim 13, comprising:
threading said insert;
securing said insert to said tubular by threads.

15. The method of claim 12, comprising:
placing a removable material in said passage;
leaving said material in position during said drilling;
removing said material after said drilling.

16. The method of claim 15, comprising:
removing said material by exposure to well conditions or a stimulus applied downhole.

17. A method for producing from a wellbore, comprising:
connecting at least a portion of a tubular string to a bit and rotating them in tandem in the wellbore when drilling the wellbore;
circulating pressurized fluid through said string to said bit to clear cuttings produced during drilling to the surface of the wellbore;
providing at least one selectively open port in said string said port further comprising a sand control media;
drilling the wellbore with said port closed; and
opening said port without string rotation after said drilling to produce well fluids through said sand control media;
expanding said tubular string in the same trip as said drilling;
retrieving said drill bit through said expanded string.

18. A method for producing from a wellbore, comprising:
connecting at least a portion of a tubular string to a bit and rotating them in tandem in the wellbore when drilling the wellbore;
circulating pressurized fluid through said string to said bit to clear cuttings produced during drilling to the surface of the wellbore;
providing at least one selectively open port in said string said port further comprising a sand control media;
drilling the wellbore with said port closed; and
opening said port without string rotation after said drilling to produce well fluids through said sand control media;
expanding said tubular string in the same trip as said drilling;
running in said tubular string with a run in string;
mounting a swage on said run in string; and
expanding said tubular string with said swage;
capturing said bit with said run in string after said expanding; and
retrieving said bit through said tubular string.

* * * * *